United States Patent [19]

Biasini

[11] Patent Number: 4,703,952

[45] Date of Patent: Nov. 3, 1987

[54] FOLDER FOR CARRYING AND DISPLAYING SHEETS OF MATERIAL

[75] Inventor: Americole R. Biasini, Bellingham, Wash.

[73] Assignee: Roy J. Maier Products, Sun Valley, Calif.

[21] Appl. No.: 894,206

[22] Filed: Aug. 7, 1986

[51] Int. Cl.[4] ..... B42D 3/00

[52] U.S. Cl. ..... 281/45; 281/15 R; 281/33; 229/72

[58] Field of Search ..... 40/10, 12, 121; 206/311, 232, 492, 312; 229/68 R, 1.5, 72; 281/15 R, 15 A, 15 B, 16, 17, 21 R, 31, 29, 33, 42, 45; 412/4

[56] References Cited

U.S. PATENT DOCUMENTS

| | | | |
|---|---|---|---|
| 2,573,191 | 10/1951 | Finch | 281/33 |
| 3,858,790 | 1/1975 | Humphrey | 229/72 |
| 3,870,223 | 3/1975 | Wyant | 229/72 |
| 4,301,962 | 11/1981 | Monckton et al. | 229/72 |
| 4,636,179 | 1/1987 | Gentile et al. | 281/29 |

FOREIGN PATENT DOCUMENTS

| | | | |
|---|---|---|---|
| 458085 | 3/1928 | Fed. Rep. of Germany | 281/33 |
| 3882 | of 1906 | United Kingdom | 281/33 |

*Primary Examiner*—Paul A. Bell

*Attorney, Agent, or Firm*—Blakely, Sokoloff, Taylor & Zafman

[57] ABSTRACT

In a folder of the type used for carrying sheets of material and being adaptable for displaying the sheets, there is provided a folder having a pair of panels joining together and being foldable at a center of the folder. Each panel has a pocket portion for storing the sheets of material and a foldable ledge means for displaying the sheets when the folder is in an open position. The folder is also provided with bands for supporting the folder on the hand of a user and means for displaying the folder in an open position on substantially flat surfaces.

19 Claims, 11 Drawing Figures

Fig. 7
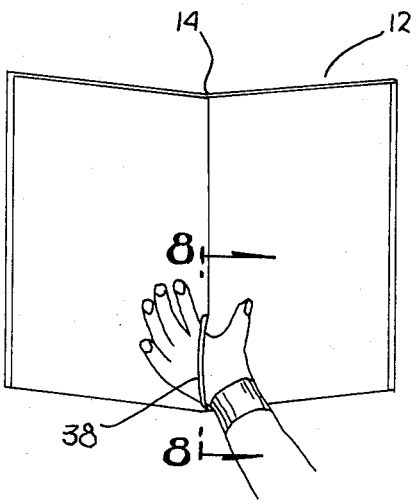
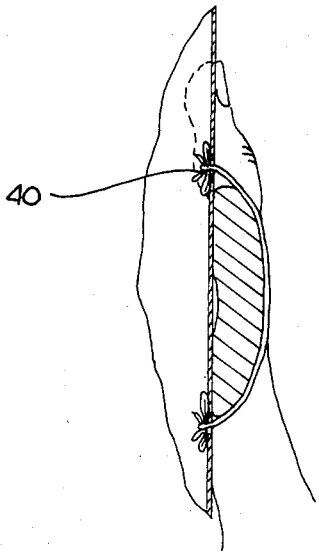
Fig. 8
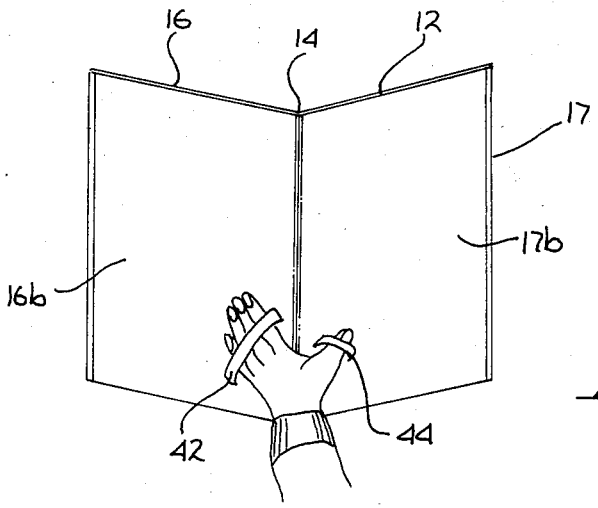
Fig. 9
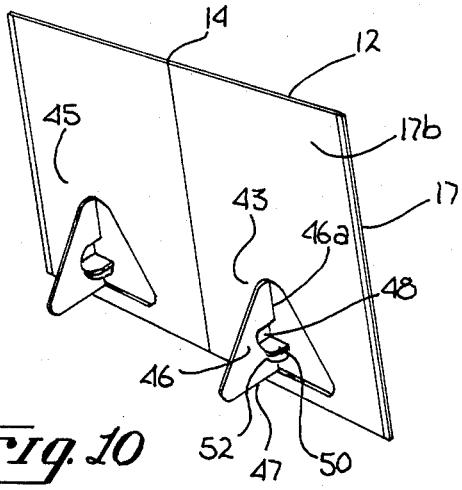
Fig. 10
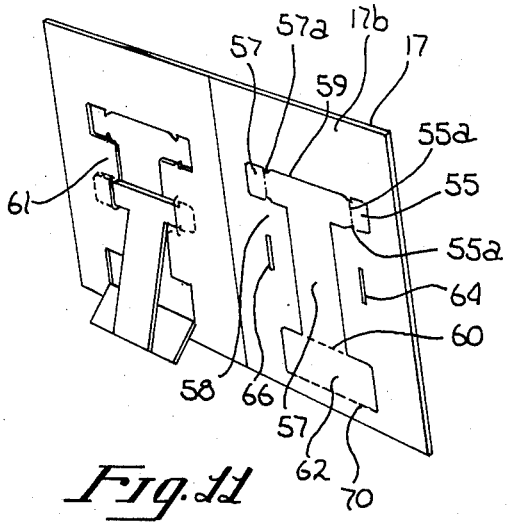
Fig. 11

FOLDER FOR CARRYING AND DISPLAYING SHEETS OF MATERIAL

FIELD OF THE INVENTION

The present invention relates to folders of the type used for carrying sheet music or the like and, more particularly, to a folder capable of being hand held in an open position without resulting fatigue to the hand of a user and which also has several unitary foldable tabs for conveniently displaying sheet music or for supporting the folder in an open and upright position.

BACKGROUND OF THE INVENTION

During the performance of choral compositions, it is necessary for each member of a chorus to read the sheet music of the compositions. Since many compositions are often performed within a single rehearsal or concert, various prior art folders exist for storing the sheet music of the different compositions. Such prior art folders typically require a choral member to grasp the folder and the sheet music together in order to secure the sheet music to the folder for the reading therefrom and for supporting the folder in an open position. However, with such prior art folders, due to the gripping force required to be exerted by the hand of a choral member in order to keep the sheet music secured against the folder and to hold the folder in an open position, the hand of such a choral member invariably fatigues, and the sheet music and/or the folder may be dropped during the course of the performance.

SUMMARY OF THE INVENTION

It is an object of the present invention to provide a folder for carrying sheets of choral music and the like and for conveniently displaying the same.

It is also an object of the present invention to provide a folder which has a means for securing the folder to the hand of a user such that hand fatigue due to holding the folder and sheet music in an open position is greatly reduced.

It is a further object of the present invention to provide a folder which may be configured to support the folder in an open and generally upright position on substantially flat surfaces. Still other objects of the present invention will become apparent from a reading of the foregoing specification.

The aforementioned objects are accomplished in a folder of the type used for carrying sheets of material which is adaptable for displaying such sheets, said folder having a pair of panels joining together and foldable at the center of the folder each panel having inner and outer surfaces such that the inner surface of each panel are disposed on the inside of the folder and the outer surface of each panel are disposed on the outside of the folder when the folder is in a closed position, at least one of the inner surfaces having a bottom portion with a foldable ledge means disposed thereon, the ledge means of the bottom portion having a first tab unitary with the bottom portion and outwardly foldable about a first substantially horizontal line. The ledge means of the bottom portion also has at least one support tab which is also unitary with the bottom portion and foldable about a first substantially vertical line such that the support tab is foldable so as to support the first unitary tab when the support tab is outwardly folded to a position substantially orthogonal to the bottom portion.

At least one of the outer surfaces of the folder may also be provided with a support means for supporting the folder in an open and upright position on a substantially flat surface, the support means having a second tab unitary with the outer surface. The second tab also has a recess and outwardly foldable about a second substantially vertical line. The support means are also provided with a locking tab which is also unitary with the outer surface and outwardly foldable about a second substantially horizontal line, the locking tab being disposed on the outer surface such that when the second tab is outwardly folded about the second substantially vertical line and the locking tab is outwardly folded about the second substantially horizontal line, the locking tab engages with the recess of the second tab, thereby substantially locking the second tab in an outwardly folded position.

The invented folder may also be provided with means for securing the hand of a user to the folder comprising a band or strap disposed on the outer surface thereof, and with alternative means for supporting the folder in an open and upright position.

BRIEF DESCRIPTION OF THE DRAWINGS

FIG. 7 is a rear perspective view of the invented folder having a securement band for securing the folder to the hand of a user;

FIG. 8 is a partial cross-sectional view of the securement band shown in FIG. 7 and taken along lines 8—8 thereof;

FIG. 9 is a rear perspective view of the invented folder having a pair of securement bands for securing the folder to the fingers and thumb of a user;

FIG. 10 is a rear perspective view of the invented folder having outwardly foldable support means;

FIG. 11 shows a rear perspective view of the invented folder having downwardly foldable support means.

DETAILED DESCRIPTION OF THE INVENTION

Figure 1:
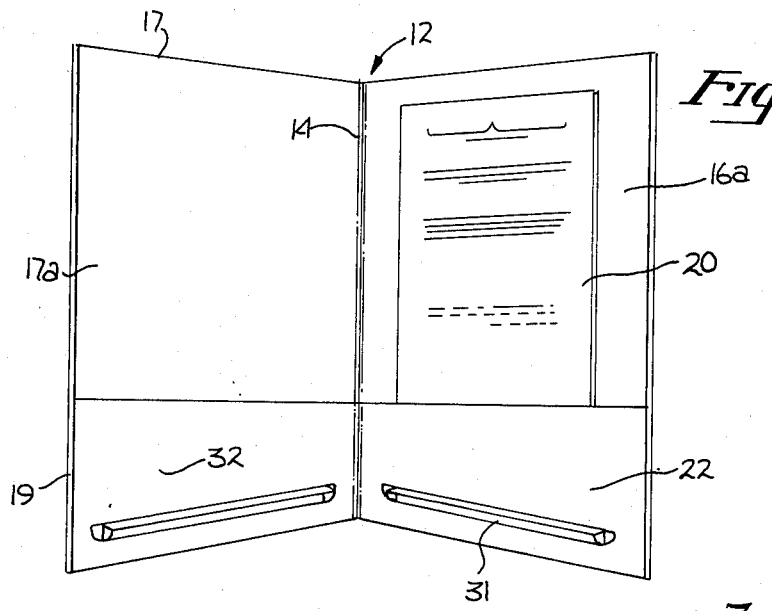
FIG. 1 is a front perspective view showing the invented folder in an open position.
Figure 3:
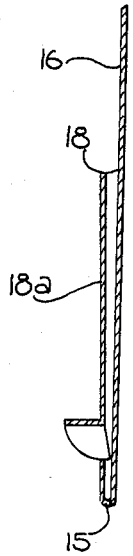
FIG. 3 shows a side partial cross-sectional view of the invented folder of FIG. 2 taken along lines 3—3 of FIG. 2.
Figure 4:
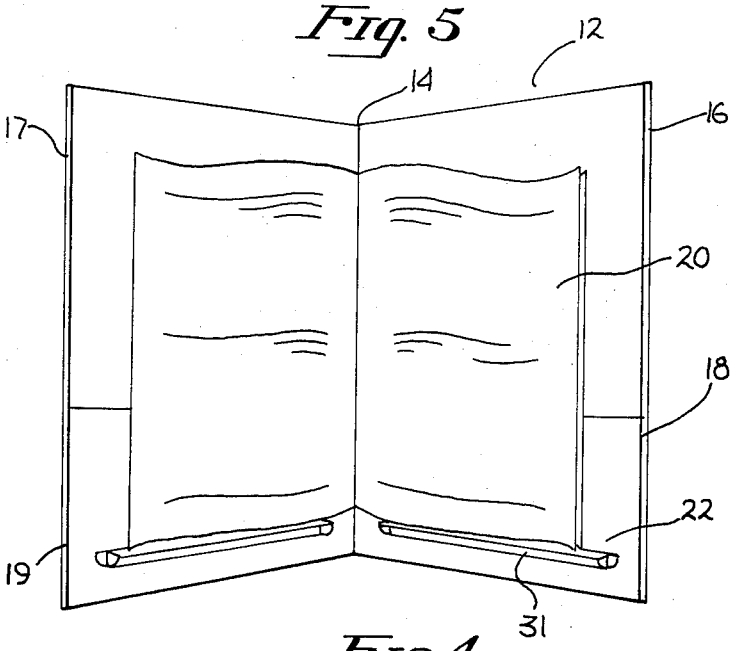
FIG. 4 is a perspective view of the invented folder similar to that of FIG. 1.

Referring now to FIG. 1, there is shown a perspective view of the invented folder 12 in an open and upright position. The invented folder 12 may be comprised of cardboard, resilient plastic, or any similar material and has first and second panels 16 and 17 which are hingedly connected to one another at the center 14 of the folder 12. Panels 16 and 17 have, respectively, inner surfaces **16*a* and 17*a* and outer surfaces 16*b* and 17*b* (shown in FIGS. 7–11). Inner surfaces 16*a* and 17*a* also have, respectively, bottom pocket portions 18 and 19. The bottom pocket portion may be unitary with its adjacent panel (i.e., as shown in FIG. 3) wherein the bottom pocket portion 18 extends from panel 16 and is bent upwardly about fold line 15) or may be otherwise attached (i.e., sewn, glued, etc.) to the adjacent panel. Bottom pocket portions 18 and 19 are, respectively, substantially co-planar with panels 16 and 17. As shown in FIG. 4, each bottom pocket portion has a ledge means 22 and 32 for supporting a booklet of choral music 20 thereon, thereby permitting the convenient turning of the pages of the sheet music booklet 20 without removing the sheet music booklet 20 from its supporting relationship on ledge means 22 and 32**.

Figure 2:
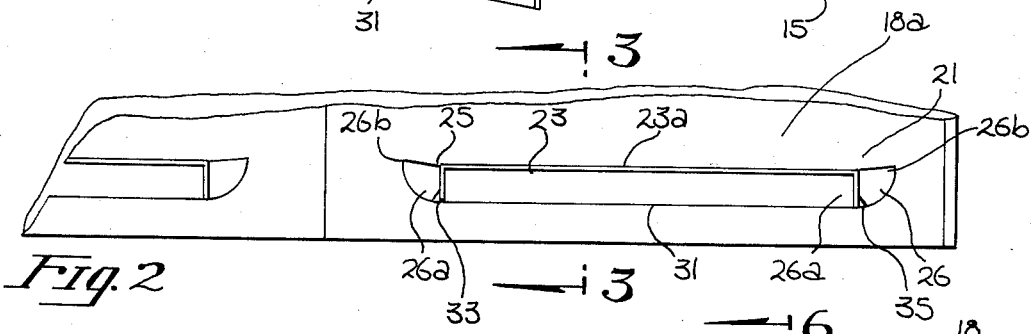
FIG. 2 is a front sectional view of a bottom portion of the invented folder of FIG. 1.

In FIG. 2 there is shown a sectional view of the folder 12 showing a portion of bottom pocket portions of 18 and 19 (bottom pocket portion 19 mirrors but is otherwise identical to bottom pocket portion 18). FIG. 2 shows ledge means 22 in its downwardly folded position (i.e., when substantially co-planar with bottom pocket portion 18) and a portion of ledge means 32 also in its downwardly folded position. Ledge means 32 mirrors, but is otherwise identical to, ledge means 22, and hence a description of the operation of ledge means 22 is provided in order to impart a complete understanding of both ledge means 22 and 32. Ledge means 22 includes radiused lateral support tabs 26 and 29 and horizontal tab 23. Ledge means 22 is integral with the outer surface 18*a* of bottom pocket portion 18 and is die-cut therefrom in a slit extending downwardly and circumferentially around lateral support tabs 26 and 29, over notch portions 33 and 35 and across the bottom portion 31 of horizontal tab 23 such that a slit extends from point 21 of FIG. 2 to point 25 of FIG. 2, thereby separating lateral support tabs 26 and 29 and horizontal support tab 23 from the bottom of the outer surface 18*a* of bottom pocket portion 18. Ledge means 22 is also provided with a horizontal foldline 23*a* and with vertical fold lines 26*a* and 29*a*. Horizontal tab 23 is outwardly foldable along horizontal fold line 23*a* while lateral support tabs 26 and 29 are vertically foldable along vertical fold lines 26*a* and 29*a*.

To place ledge means 22 in its outwardly folded position (i.e., as shown in FIGS. 1, 3 and 4) the bottom edge 31 of horizontal tab 23 may be gripped and pulled upwardly such that horizontal tab 23 is folded upwardly about horizontal fold line 23*a* until horizontal tab 23 is in an orthogonal position with respect to the plane defined by the outer surface 18*a* of bottom pocket portion 18. (i.e., as shown in FIG. 3). Lateral support tabs 26 and 29 may then be folded downwardly about vertical fold line 26*a* and 29*a* until end portions 26*b* and 29*b* are pushed over notch portions 33 and 35 such that end portions 26*b* and 29*b* are disposed on the sides of notch portion 33 and 35 that face the center of horizontal tab portion 23. It will be apparent to one skilled in the art that since ledge means 22 is die-cut from outer surface 18*a* of bottom pocket portion 18 and integrally formed therewith, when ledge means 22 is outwardly folded and configured into its orthogonal position, a recess 31 (shown in FIGS. 1 and 4) is left from the upward folding of horizontal tab portion 23 and the downward folding of lateral support tabs 26 and 29.

Figure 5:
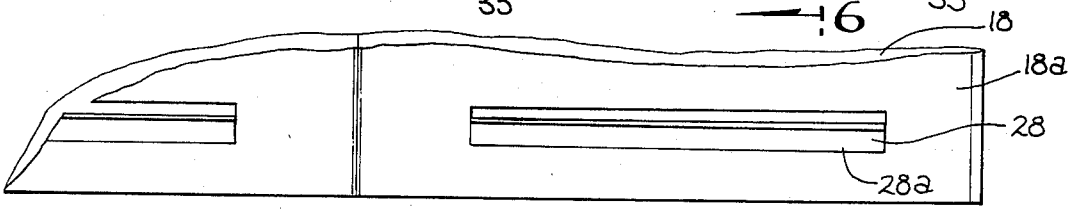
FIG. 5 is a sectional view of a bottom portion of a second embodiment of the invented folder.
Figure 6:
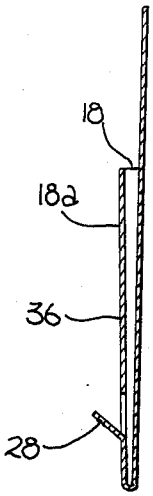
FIG. 6 shows a partial cross-sectional view of the second embodiment of the invented folder of FIG. 5 taken along lines 6—6 of FIG. 5.

In FIGS. 5 and 6 there is shown another embodiment of a ledge means 36 for supporting sheet music and the like. In FIG. 5 there is shown a ledge means 36 in an outwardly folded position (i.e. as shown in FIG. 6) which consists of a single unitary horizontal tab 28 downwardly foldable about horizontal line 28*a*. Horizontal tab 28 is also die-cut from the outer surface 18*a* of bottom portion 18, and is therefore integral therewith. When it is desired to open the folder and store sheet music on horizontal tab 28, the same may be outwardly folded about horizontal fold line 28*a* until horizontal tab 28 extends at an angle relative to the planar surface of the outer surface 18*a* of bottom pocket portion 18, as shown in FIG. 6. Since outer surface 18*a* of bottom pocket portion 18 is formed of resilient material (i.e., such as cardboard or resilient plastic), horizontal tab 28 generally retains its position when outwardly folded as shown in FIG. 6, thus providing an adequate support means for supporting sheet music and the like thereon.

In FIG. 7 there is shown a rear view of the invented folder having a hand securement band 38 which, in a preferred embodiment, is comprised of an elastic material such as elastic cloth. Hand securement band 38 is disposed substantially vertically near the bottom of the center 14 on the outer surface of the folder 12. As shown in FIG. 8, securement band 38 is coupled to folder 12 with clips or pins 40 and 41. As shown in FIGS. 7 and 8 when it is desired to manually retain the folder in its open position in order to, for example read sheet music stored thereon, the hand is inserted through securement band 38 until the band 38 is disposed around the back of the hand. The elastic tension of the securement band 38 holds the folder 12 against the thumb, palm and forefingers of the hand across the center 14 such that very little gripping force is required to be exerted by the hand in order to secure the folder in an open position. Accordingly, hand fatigue which occurs in other prior art folders due to the necessity of manually gripping the folder is greatly reduced.

FIG. 8 is a partial cross-sectional view of FIG. 7 taken along line 8—8 of FIG. 7 and illustrates a partial cross-sectional view of a hand disposed within the inner area of securement band 38 and the forefinger of the hand extending therefrom partially shown in phantom lines.

In FIG. 9 there is shown another embodiment of the invented folder 12 having a finger securement band and a thumb securement band 42. Both bands 42 and 44 are comprised of elastic material such as elastic cloth. Band 42 is disposed on the bottom portion of the outer surface 17*b* of panel 17 at a predetermined angle with respect to center 14. Similarly, band 44 is disposed on the bottom portion of outer surface 16*b* of panel 16 at a predetermined angle with respect to center 14. Band 42 is approximately as wide as the width of the four fingers of an average hand while band 44 is approximately as wide as the average width of the thumb of an average hand. As may be observed from FIG. 9, the bands 42 and 44 serve the purpose of securing the hand to the folder 12 across the center 14 thus relieving a user from the necessity of manually gripping the folder when holding it in an open position as shown in FIG. 9, thereby greately reducing hand fatigue.

In FIG. 10 there is shown still another embodiment of the invented folder 12 having a pair of support means 43 and 45 which are adapted to support the folder 12 in an open and upright position on substantially flat surfaces. Support means 45 mirrors but is otherwise identical to support means 43, and therefore, a detailed description of support means 43 will also convey to those skilled in the art the configuration and operation of support means of 45. The following is a description of the configuration and operation of support means 43.

Support means 43 is comprised of bottom tab portion 46, which, in the present embodiment, is generally triangularly shaped having a base portion 47. Bottom tab portion 46 has a hole or recess 48 generally disposed in the center of bottom tab portion 46 and having a notch 52 disposed thereon. Bottom tab portion 46 is die-cut from and integral with the outer surface 17*b* of panel 17 and is foldable about vertical fold line 46*a* such that bottom tab portion 46 may be outwardly folded from a position which is substantially co-planar with the outer surface 17*b* of panel 17 to a position, as shown in FIG. 10, which is substantially orthogonal to the plane of outer surface 17*b* of panel 17. Support means 43 is also provided with a locking tab 50 which is also die-cut from and integral with outer surface 17*b* of panel 17 so that when in its unfolded state, locking tab 50 is also substantially co-planar with outer surface 17*b* of panel 17.

After bottom tab portion 46 is outwardly folded about vertical fold line 46*a* to a position substantially orthogonal to the planar surface of outer surface 17*b* of panel 17, as shown in FIG. 10, locking tab portion 50 is then downwardly folded about horizontal fold line 50*a* and pushed below notch portion 52 of recess 48, thereby locking locking tab portion 50 into a substantially horizontal position and also thereby locking tab portion 46 into a substantially vertical position. When thus configured, base portion 47 supports panel 17 in an open and upright position.

In FIG. 11 there is shown still another embodiment of the invented folder 12 having support means 59 and 61. Support means 59 mirrors, but is otherwise identical to support means 61, therefore only the configuration and operation of support means 59 will be hereinafter discussed. Support means 59 includes unitary tab 58 which has a top substantially T-shaped portion 56, a central portion 57, a bottom portion 62. Unitary tab 58 is die-cut from the outer surface 16*b* of panel 16 and is thus, when in an unfolded position, is substantially co-planar with the outer surface 16*b* of panel 16. Support means 61 is shown in its unfolded co-planar state. Upper T-shaped portion 56 has foldable tab portion 55 disposed on one end of T-shaped portion 56 and a foldable tab portion 57 (shown in phantom lines) disposed on the other end of T-shaped portion 56. Foldable tab portions 55 and 57 are foldable about vertical fold lines 55*a* and 57*a*. Bottom portion 62 is foldable about horizontal fold lines 60 and 70. Support means 59 also includes vertical tab portion receiving slits 64 and 66 which are disposed on the outer surface 17*b* of panel 17 near the center thereof and are aligned with and oppose one another.

When it is desired to configure support means 59 to a position for supporting the folder 12 in an open and upright position, tab 58 is lifted outwardly from outer surface 16*b* of panel 16 and folded about horizontal fold lines 60 and 70. Foldable tab portions 55 and 57 of unitary tab portion 58 are then folded about vertical lines 55*a* and 57*a*, aligned with vertical tab portion receiving slits 64 and 66 and inserted there-through, thereby locking tab 58 into the outwardly folded position of support means 61. The bottom portion of unitary tab 58 which extends along horizontal fold line 60 thereby supports panel 17 in an open and upright position.

It will be appreciated by one skilled in the art that although various configurations and embodiments of the invented folder 18 have been explained, slightly different embodiments having slightly different patterns of die-cut tabs for supporting sheet music and for supporting the folder in an open and upright position may be used while embodying the concepts of the present invention. Therefore, it will be appreciated that the present invention may be embodied in other specific forms without departing from the spirit or essential characteristics thereof. The present embodiments are to be considered in all aspects as illustrative and unrestrictive, the scope of the invention being indicated by the appended claims rather than by the foregoing description, and all changes which come within the meaning and range of equivalency are, therefore, are intended to be embraced therein.

I claim:

1. A folder of the type used for carrying sheets of material and being adaptable for displaying said sheets, said folder comprising:

a pair of panels joining together at the center of said folder and foldable at said center, each panel having inner and outer surfaces such that said inner surface of each panel is disposed on the inside of said folder and said outer surfaces of each panel is disposed on the outside of said folder when said folder is in a closed position;

at least one of said inner surfaces having a bottom portion having a foldable ledge means disposed thereon, said ledge means comprising:

a first tab unitary with said bottom portion and outwardly foldable about a first substantially horizontal line, and at least one support tab also unitary with said bottom portion and foldable about a first substantially vertical line such that said support tab is outwardly foldable to support said first tab when said support tab is outwardly folded to a position substantially orthogonal to a plane defined by said bottom portion;

at least one of said outer surfaces having a support means for supporting said folder upon a surface when said folder is in said open position, said support means comprising:

a second tab unitary with said one outer surface, said second tab having a recess and being outwardly foldable about a second substantially vertical line, and a locking tab also unitary with said one outer surface and outwardly foldable about a second substantially horizontal line, said locking tab being disposed on said outer surface such that when said second tab is outwardly folded about said second substantially vertical line and said locking tab is outwardly folded about said second substantially horizontal line said locking tab engages with said recess of said second tab, thereby substantially locking said second tab in an outwardly folded position.

2. The folder as claimed in claim 1 wherein said bottom portion further comprises a substantially horizontal slit extending along the upper edge thereof thereby forming a pocket comprised of said bottom portion and said panel, whereby said panel is adapted to store said sheet material.

3. The folder as claimed in claim 2 which further comprises:

a first band disposed on the outer surface of one of said pair of panels near about said center of said folder, said first band having a width at least as wide as the width of four fingers of an average hand;

a second band disposed on the outer surface of the other panel of said pair of panels near about said center of said folder, said second band having a width at least as wide as the average width of a thumb of said hand, wherein, when said fingers and said thumb are inserted, respectively, between said first band and said folder and between said second band and said folder, said bands secure said hand to said folder.

4. The folder as claimed in claim 3 wherein said first and second bands are comprised of elastic material.

5. The folder as claimed in claim 2 which further comprises a band disposed substantially vertically along said outer surfaces of said panels across said center of said folder thereby permitting insertion of a hand between said band and said folder such that said band secures said hand to said outer surfaces of said folder.

6. The folder as claimed in claim 5 wherein said band is comprised of elastic material.

7. A folder of the type used for carrying sheets of material and being adaptable for displaying said sheets, said folder comprising:

a pair of panels joined together at the center of said folder and foldable about said center, each panel having inner and outer surfaces such that said inner surface of each panel is disposed on the inside of said folder and said outer surface of each panel is disposed on the outside of said folder when said folder is in a closed position;

a bottom portion disposed on at least one of said inner surfaces, said bottom portion comprising:

a foldable ledge means disposed thereon, said ledge means comprising a first tab unitary with said bottom portion and outwardly foldable about a first substantially horizontal line; and at least one support tab also unitary with said bottom portion and foldable about a first substantially vertical line such that said support tab is foldable so as to support said first tab when said support tab is outwardly folded to a position substantially orthogonal to the plane of said bottom portion;

at least one of said outer surfaces having a support means for supporting said folder upon a surface when said folder is in said open position, said support means comprising:

a second tab having a top portion, a central portion, and a bottom portion, said top portion having a first tab portion disposed on one side of said top portion and a second tab portion disposed on the other side of said top portion, said first and second tab portions being foldable about second and third substantially vertical lines, respectively, at the edges thereof abutting said upper portion; and a pair of substantially vertical slits disposed on said outer surface and below said upper portion of said second tab when said second tab is substantially co-planar with said outer surface, said second tab being outwardly foldable about second and third substantially horizontal lines thereby permitting folding of said lower portion about said second substantially horizontal line and said third substantially horizontal line until said tab portions align with said substantially vertical slits thereby permitting folding of said tab portions about said second and third substantially vertical lines thereof and insertion of said tab portions into said slits, thereby locking said second tab in an outwardly folded position such that said support means serves to support said folder in said open position.

8. The folder as claimed in claim 7 wherein said bottom portion further comprises a substantially horizontal slit extending along the upper edge thereof thereby forming a pocket comprised of said bottom portion and said panel, whereby said panel is adapted to store said sheet material.

9. The folder as claimed in claim 8 which further comprises:

a first band disposed on the outer surface of one of said pair of panels near about said center of said folder, said first band having a width at least as wide as the width of four fingers of an average hand;

a second band disposed on the outer surface of the other panel of said pair of panels near about said center of said folder, said second band having a width at least as wide as the average width of a thumb of said hand, wherein when said fingers and said thumb are inserted, respectively, between said first band and said folder and between said second band and said folder, said pair of bands collectively secure said hand to said folder.

10. The folder as claimed in claim 9 wherein said bands are comprised of elastic material.

11. The folder as claimed in claim 7 which further comprises a band disposed substantially vertically along said outer surfaces of said panels across said center of said folder thereby permitting insertion of a hand between said band and said folder, such that said band secures said hand to said outer surfaces of said folder.

12. The folder as claimed in claim 11 wherein said band is comprised of elastic material.

13. A folder of the type used for carrying sheets of material and being adaptable for displaying said sheets, said folder comprising:

a pair of panels joined together at the center of said folder and foldable at said center, said panels having inner and outer surfaces wherein said inner surfaces are defined as the surfaces which face one another when said folder is in a closed position and said outer surfaces are defined as the surfaces which face outwardly when said folder is in a closed position;

a bottom portion disposed on at least one of said inner surfaces, said bottom portion having a foldable ledge means disposed thereon, said ledge means comprising a first tab unitary with said bottom portion and foldable about a first substantially horizontal line such that said first tab is outwardly foldable about said substantially horizontal line such that said ledge means extends at a pre-determined angle with respect to the planar surface of said bottom portion thereby providing a means for supporting said sheets of material.

14. The folder as claimed in claim 13 wherein said bottom portion further comprises a substantially horizontal slit extending along the upper edge thereof thereby forming a pocket comprised of said bottom portion and said panel, whereby said panel is adapted to store said sheet material.

15. The folder as claimed in claim 14 wherein said folder further comprises a band disposed substantially vertically along said outer surfaces of said panels at said center of said folder, said band being at least as wide as the width of an average hand, thereby permitting insertion of a hand therethrough such that said band secures said hand to said outer surfaces of said folder.

16. The folder as claimed in claim 15 wherein said band is comprised of elastic material.

17. The folder as claimed in claim 13 wherein said folder further comprises:

a first band disposed on the outer surface of one of said pair of panels near about said center of said folder, said first band having a width at least as wide as the width of four fingers of an average hand;

a second band disposed on the outer surface of the other one of said pair of panels near about said center of said folder, said second band of said pair of bands having a width at least as wide as the width of the thumb of said average hand;

wherein, when said fingers and said thumb are inserted, respectively, under said first band and said second band, said pair of bands collectively secure said hand to said folder.

18. The folder as claimed in claim 17 wherein said bands are comprised of elastic material.

19. The folder as claimed in claim 13 wherein at least one of said outer surfaces further comprises:

a support means for supporting said folder on a surface when said folder is in said open position, said support means comprising:

a second tab unitary with said outer surface, said second tab having a recess, said recess having a notch means, said second tab being outwardly foldable about a substantially vertical line; and a locking tab also unitary with said outer surface and outwardly foldable about a second substantially horizontal line, said locking tab being disposed on said outer surface such that when said second tab is outwardly folded about said substantially vertical line and said locking tab is outwardly folded about said second substantially horizontal line, said locking tab engages with said notch means thereby substantially locking said second tab in an outwardly folded position.

* * * * *